US009586416B2

(12) United States Patent
Yosefi et al.

(10) Patent No.: US 9,586,416 B2
(45) Date of Patent: Mar. 7, 2017

(54) TRIPLE MODE PRINTER

(71) Applicants: Hanan Yosefi, Ganey Tikva (IL); Erez Zimerman, Nes Ziona (IL); Avi Zehavi, Hod HaSharon (IL); Nadav Hollander, Netanya (IL)

(72) Inventors: Hanan Yosefi, Ganey Tikva (IL); Erez Zimerman, Nes Ziona (IL); Avi Zehavi, Hod HaSharon (IL); Nadav Hollander, Netanya (IL)

( * ) Notice: Subject to any disclaimer, the term of this patent is extended or adjusted under 35 U.S.C. 154(b) by 0 days.

(21) Appl. No.: 14/519,485

(22) Filed: Oct. 21, 2014

(65) Prior Publication Data

US 2016/0107456 A1 Apr. 21, 2016

(51) Int. Cl.
*B41J 11/00* (2006.01)

(52) U.S. Cl.
CPC ..... *B41J 11/0085* (2013.01); *B41J 11/001* (2013.01)

(58) Field of Classification Search
CPC ..... B41J 25/308; B41J 3/4078; B41J 13/00; B41J 13/0072; B41J 11/0085; B41J 11/001; B65H 2301/12; B65H 2405/10
USPC ..... 347/101, 104; 400/55, 56
See application file for complete search history.

(56) References Cited

U.S. PATENT DOCUMENTS

| | | | | |
|---|---|---|---|---|
| 1,626,595 | A * | 5/1927 | Caffray | 101/152 |
| 5,421,459 | A * | 6/1995 | Mazzotti | 206/549 |
| 5,806,425 | A * | 9/1998 | Newman et al. | 101/127.1 |
| 6,296,403 | B1 | 10/2001 | Duchovne | |
| 7,901,150 | B2 | 3/2011 | Liberman et al. | |
| 8,764,183 | B2 * | 7/2014 | Schaeffer | B41J 3/28 347/101 |
| 2006/0043666 | A1 * | 3/2006 | Piccinino, Jr. | B65H 5/224 271/276 |
| 2008/0143032 | A1 * | 6/2008 | Liberman et al. | 270/1.01 |
| 2009/0284575 | A1 * | 11/2009 | Verhoest et al. | 347/104 |

FOREIGN PATENT DOCUMENTS

| | | |
|---|---|---|
| RU | 02167063 | 5/2001 |
| WO | WO 2004/037543 | 5/2004 |
| WO | WO 2005/074519 | 8/2005 |

* cited by examiner

*Primary Examiner* — Julian Huffman
*Assistant Examiner* — Sharon A Polk
(74) *Attorney, Agent, or Firm* — Robert G. Lev

(57) ABSTRACT

A system for enabling a wide format ink jet printer to print onto discontinuous flexible media. A wide format inkjet printer includes a print head and a feed roller that can be configured as a flat bed printer for printing onto stiff media or as a roll to roll printer for printing onto continuous flexible media. Addition of a tray connected to a vacuum pump that can be fed using the feed roller when in flat bed configuration enables the printer to be used for printing onto flexible discontinuous media.

20 Claims, 8 Drawing Sheets

TRIPLE MODE PRINTER

BACKGROUND

The present invention is directed to providing a printer, typically a wide format or extra wide format printer, that is capable of printing onto media provided as roll stock or as single sheets of discontinuous media, and also onto single separate sheets of flimsy media and onto relatively small discrete articles that may be flimsy or stiff, and to a method of printing such items.

Digital printing is widely used for printing posters, wall decorations, signs and the like. The material to be printed, if flexible, is typically provided on a continuous roll as what is commonly known as roll stock which is advanced roll to roll past the print head. Sometimes however, particularly when printing onto a stiff material, the material to be printed is provided in sheet form and the printing technique is then known as flat bed printing.

In all printing technologies advancing systems are required to accurately position the material to be printed with respect to the printing head. Even a small deviation from the correct positioning results in noticeable printing defects. Unfortunately, the wider the sheet, the greater the tendency for it to be warped or mis-aligned whilst being fed past the printer head.

To save space and equipment costs, it is useful for a single machine to be able to operate as both a flat bed printer and as a roll to roll printer. The wider the material to be printed, the more difficult it is to obtain alignment, and providing a single wide format printer that is capable of both flat bed and roll to roll printing, though desirable, is not easily achieved.

WO04037543 to Nur Macroprinters LTD., titled "Advancing System and Method for a Digital Printing Apparatus", describes a printer apparatus comprising a printing head system and an advancing system. The printing head includes a print head assembly mounted for movement along at least one horizontal axis with respect to a printing area. The advancing system is configured and operable for enabling to selectively locate the printing area in either one of a first or a second printing plane arranged in vertically spaced-apart relationship, thereby selectively exposing the first or second printing plane to the print head assembly for printing. The first and second printing planes are defined by, respectively, a first flat-bed assembly and a second roll-to-roll assembly of the advancing system.

Nur Macroprinter's solution requires moving the printer head from one printing plane to another. In each printing mode the printer head moves over a relatively wide table in two directions. The two printing modes use different printing tables. Moving from one printing mode to another in this manner is likely to be time consuming. Furthermore, since the printer head may be moved with respect to the substrate to be printed in three directions, accurate, repeatable alignment and ease of moving from one printing type to the other is not easy. Because two printing tables are used, both require calibrating to attain planarity in a parallel plane to the movement of the printer head, and this is not easily achieved since the printing tables have a tendency to warp. Indeed movement of the printing table is best avoided. Furthermore, the machine footprint is large relative to the width of the media that can be printed because there are two printing areas that cannot be used at once.

U.S. Pat. No. 6,296,403 to Scitex Vision describes a dual-mode printer for printing on both flexible and rigid substrates that includes a table for providing a substantially planar support surface for supporting a substrate thereupon.

A flexible-substrate feed system is configured to feed a flexible substrate in a given feed direction across the support surface. The printer has a print head configured for depositing a printing medium on a substrate as part of a printing process. A motion system is configured to generate relative displacement between the print head and the support surface in at least a first direction parallel to the feed direction. This combination of components allows the printer to be used in a flexible-substrate mode in which relative displacement between the substrate and the print head is generated at least in part by the flexible-substrate feed system and in a rigid-substrate mode in which relative displacement between the substrate and the print head is generated exclusively by the motion system. The table used is a wide table suitable for flat bed printing, which, when used for roll-to-roll printing, is inherently unsuitable as the distance between the rollers is large, and the flexible substrate to be printed is likely to assume a wavy surface which adversely affects the resolution of the printing thereon. Russian Patent Number RU 2167063 relates to a method of printing wherein the substrate to be printed is fed roll to roll and the table moves as well.

WO05074519 to L & P Property Management Company describes an apparatus and a method of ink jet printing that use a system for feeding a substrate longitudinally relative to a support area and a system for moving a print head parallel to the direction of the substrate feed. Indexing between transverse scan rows of a print head is carried out initially by the substrate feed system and the actual feed distance is measured using an encoder or other substrate position measurement device. A controller determines the amount of any error that occurs between the actual and the desired feed distances. The controller then sends signals to move the print head to compensate for any error in the feed system feed. Compensating adjustments are then made to the next subsequent substrate indexing step so that the print head tends to move back toward its home or zeroed position with its next correction and does not walk away from this home position as a result of cumulative movements. For printers that have bridges that are moveable relative to the machine frame on which the print head is carried, print head motion is achieved by moving the bridge, for example, by actuating a linear servo bridge motion system. For fixed bridge roll-to-roll printers, the print head can be caused to shift longitudinally on the bridge to make the correcting movements.

The controller for controlling the amount of error and the compensation thereof indicate the problems in obtaining accurate positioning where the bridgehead moves relative to the support area, the support area moves relative to the material to be printed, and the material to be printed is fed as well.

Thus, despite the developments described above, there is a need for a simple, reliable printing machine that is capable of accurately printing onto continuous substrate roll-to-roll in a first mode, or onto single sheets in a second mode, where conversion of the machine from one mode to the other is relatively easy.

U.S. Pat. No. 7,901,150, titled "Dual Mode Printer" and assigned to the present applicants, discloses a wide or super wide digital printer comprising a printer head box that reciprocates from left to right across a wide or super wide printing table having a length of less than 20 cm that is supported by a fixed support, and a feed roller and a guiding roller that are moveably coupled to the fixed support, wherein the wide or super wide digital printer is configurable as a roll to roll printer by lowering the feed roller and the guiding roller to a lowered configuration wherein uppermost parts of the feed roller and the guiding roller are below upper surface of printing table, or as a discontinuous sheet printer by raising the feed roller and the guiding roller to a raised configuration wherein the uppermost parts of the feed roller and the guiding roller are collinear with the upper surface of the printing table.

Though very effective in printing onto relatively stiff media such as boards of various types, that cannot be provided as roll stock, the solution proposed in U.S. Pat. No. 7,901,150 has proven limited in its capabilities to print onto thin sheets of paper or film that lack the integral stiffness required to be forwarded by the feed rollers, when not provided as roll stock. It is also unsuitable for printing onto stiff but discontinuous media having small dimensions, such as badges, coasters, floor tiles and the like, unless provided as larger sheets and then singulated after printing, which is sometimes impossible or undesirable for various reasons. It is particularly ineffective at printing onto discrete, flimsy items having small dimensions, such as for printing additional material onto pre-printed flyers or onto handkerchiefs, and the like.

SUMMARY OF THE INVENTION

A first aspect is directed to a system for printing onto discontinuous media comprising a printer, a vacuum pump and a tray; the printer comprising a print head and a feed roller for roll to roll printing by forwarding media past the print head; the tray comprising an upper plate joined to a parallel lower plate by a perimeter edge, the upper plate and lower plate being separated by a small separation to form a hollow box bounded by the upper plate, the lower plate and the perimeter edge, the upper plate being provided with an array of through holes, the hollow box being coupleable to a vacuum pump for evacuation of air from within, such that the discontinuous media placed over at least a portion of the array of holes is held in place by suction created by the vacuum pump.

In one embodiment, the printer comprises a print table the feed roller and a guiding roller, and is selectively configurable between: a lowered configuration wherein the feed roller and guiding roller are positioned below the print table for roll to roll printing onto flexible media provided as roll stock; a coplanar position wherein said feed roller, print table and guide roller are in linear alignment for flat bed printing onto discrete sheets of substantially stiff media, and a raised configuration wherein the feed roller and guide roller are positioned above the print table and the tray is supported by the feed roller and the guide roller and is separated from the print table by a clearance gap.

In one embodiment, each of said pair of rollers is mounted on a spindle that is fixed to a rocker plate on each end, each rocker plate being movable about an axle fixed to the fixed support, the moving of each rocker between the lowered position, the coplanar position and the raised position being driven by a drive system, and determined by peg in slot mechanisms, wherein each rocker comprises a slot therethrough through which a peg fixed to the fixed support passes, and each rocker can be moved between three positions to selectively position the feed roller and guiding roller below, in line with or above the printing table.

Typically, the tray is at least 40 inches wide.

Optionally, the tray is at least 60 inches wide.

Optionally, the system further comprises a framework for partially covering the upper plate of the tray and providing windows into which media to be printed may be positioned.

Optionally, the printer is a wide or super-wide printer.

Optionally, the system comprises a plurality of trays arranged alongside each other across the width of the printer.

A second aspect is directed to a method of printing onto discontinuous media, by (i) providing a digital printer comprising a print head, a feed roller and a guide roller; a vacuum pump and a tray comprising an upper plate joined to a parallel lower plate by a perimeter edge, the upper plate and lower plate being separated by a small separation to form a hollow box, the upper plate being provided with an array of through holes, the hollow box being coupleable to the vacuum pump for evacuation of air from within the hollow box; (ii) positioning the discontinuous media on the tray and holding the discontinuous media in place on the upper plate by suction provided by the vacuum pump; (iii) positioning the tray onto the feed roller and the guiding roller, and (iv) forwarding the tray past the print head using the feed roller.

Optionally, the digital printer further comprises a print table and is selectively configurable in three configurations by raising and lowering the rollers with respect to the print table, to selectively print either: (a) onto continuous media in a roll to roll configuration wherein the feed roller and the guide roller are in a lower configuration below the print table; (b) onto large sheets of stiff discontinuous media in a flat bed configuration wherein the feed roller and the guide roller are in line with the print table, or (c) onto discontinuous media not provided as large stiff sheets, wherein the feed roller and the guide roller are positioned in a raised configuration above the height of print table.

Optionally, the discontinuous media not provided as large stiff sheets is flimsy.

Optionally, the discontinuous media not provided as large stiff sheets is provided as small discrete objects.

Optionally, the tray is at least 40 inches wide.

Alternatively, the tray is at least 60 inches wide.

Optionally, step (i) further comprises providing a framework and positioning the framework to partially cover the upper plate of the tray, said framework defining windows into which the discontinuous media to be printed may be positioned.

Optionally, step (iii) further comprises aligning the tray with the feed roller.

Optionally, aligning the tray with the feed roller comprises aligning an edge of the tray with one of the group consisting of an edge of the print table, the feed roller, a track along which the printer head reciprocates, and an alignment edge that is itself in fixed alignment with the print table.

Optionally, aligning the tray with the feed roller comprises aligning an edge of the tray with an edge positioner that is coupleable to a track along which a carriage for the printer head reciprocates.

Optionally, the edge positioner is coupleable to the carriage.

Typically, the printer is a wide format printer or an extra wide format printer.

Optionally, the system comprises a plurality of trays that may be positioned alongside each other across the width of the printer.

A third aspect is directed to a tray for supporting discrete media such that the tray may be positioned on the feed roller and guide roller of a roll to roll printer to retrofit the roll to roll printer for printing onto the discrete media, and moved by the feed roller past a printhead; the tray comprising an upper plate joined to a parallel lower plate by a perimeter edge, the upper plate and lower plate being separated by a small separation to form a hollow box, the upper plate comprising an array of through holes, the tray being coupleable to a vacuum pump for evacuation of air from within, such that the discontinuous media placed over at least a portion of the array of holes is held in place by suction created by the vacuum pump.

Optionally, the perimeter edge comprises at least one straight edge for accurate positioning with respect to the feed roller of the printer.

Optionally, the tray is substantially rectangular.

Optionally, the tray has a width of at least 40 inches.

Alternatively, the tray has a width of at least 60 inches.

Optionally, the roll to roll printer is a wide format roll to roll printer.

Optionally, the tray further comprises a framework for partially covering the upper plate and providing apertures into which the discontinuous media to be printed may be positioned.

BRIEF DESCRIPTION OF THE FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice.

In the accompanying drawings:

FIG. 1 is a schematic cross section of a double configuration feed roller system of the prior art, configured for roll to roll printing;

FIG. 2 is a schematic cross section of the double configuration feed roller system of FIG. 1, configured for printing onto discontinuous large stiff substrates;

FIG. 3 is an isometric projection of the drive system for interchanging between the configuration of FIG. 1 and the configuration of FIG. 2;

FIG. 4 is a schematic cross section of the double configuration feed roller system of the present invention, configured for printing rigid substrates with roller tables adjacent to the printer;

FIG. 5A is a schematic illustration of a tray coupled to a vacuum pump for supporting discontinuous media which may be flimsy discontinuous media or small discrete stiff objects;

FIG. 5B is a schematic cross-section through the tray of FIG. 5A,

FIG. 6 is a schematic illustration showing the tray of FIG. 5A and a framework that is positionable on the tray, and which is provided with cut out apertures for receiving discontinuous media and aiding the alignment thereof.

Figure 7:
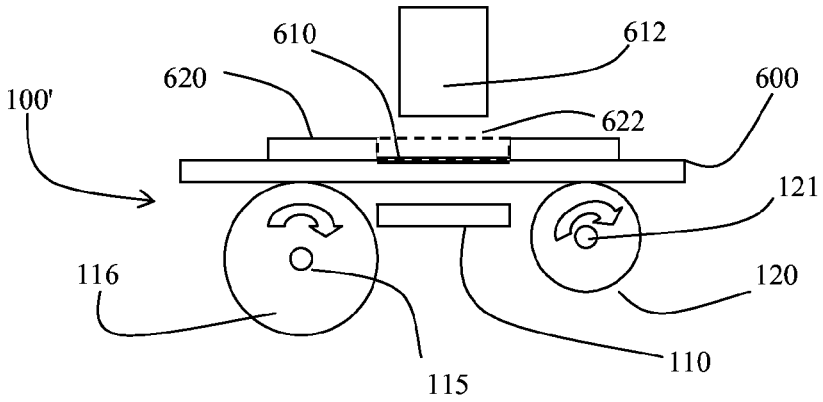
Figure 8:
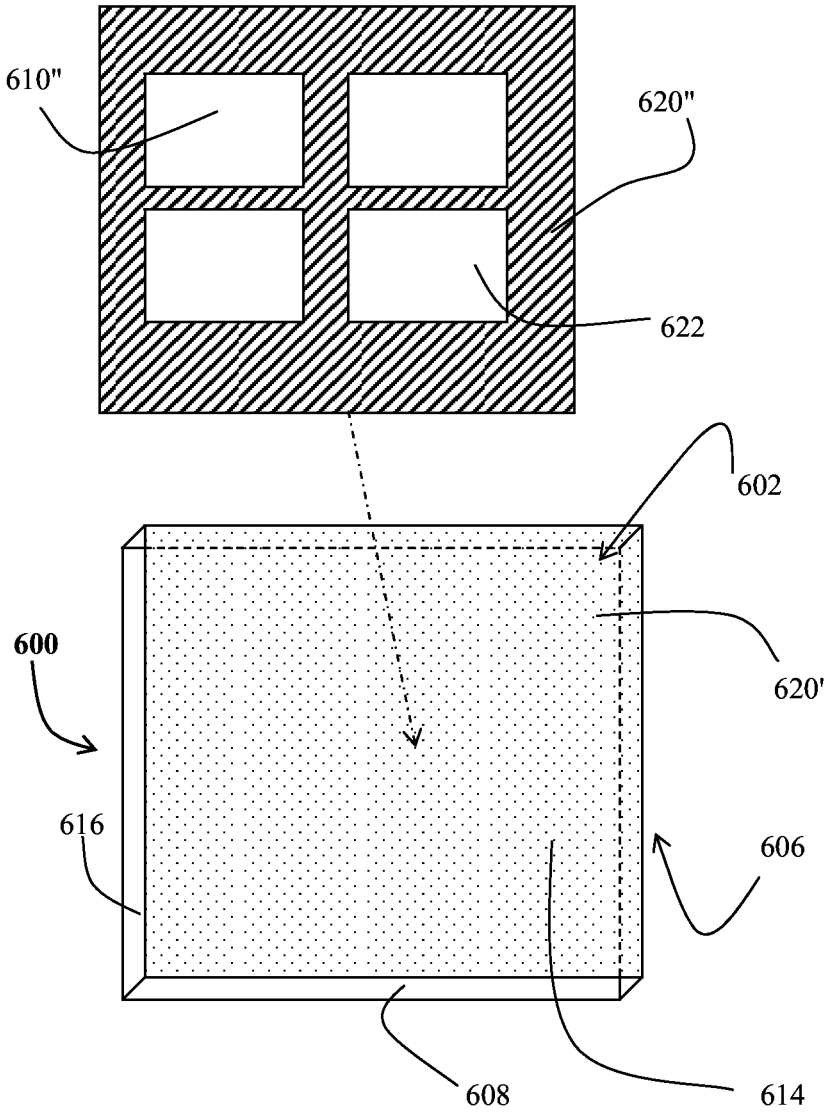
Figure 9:
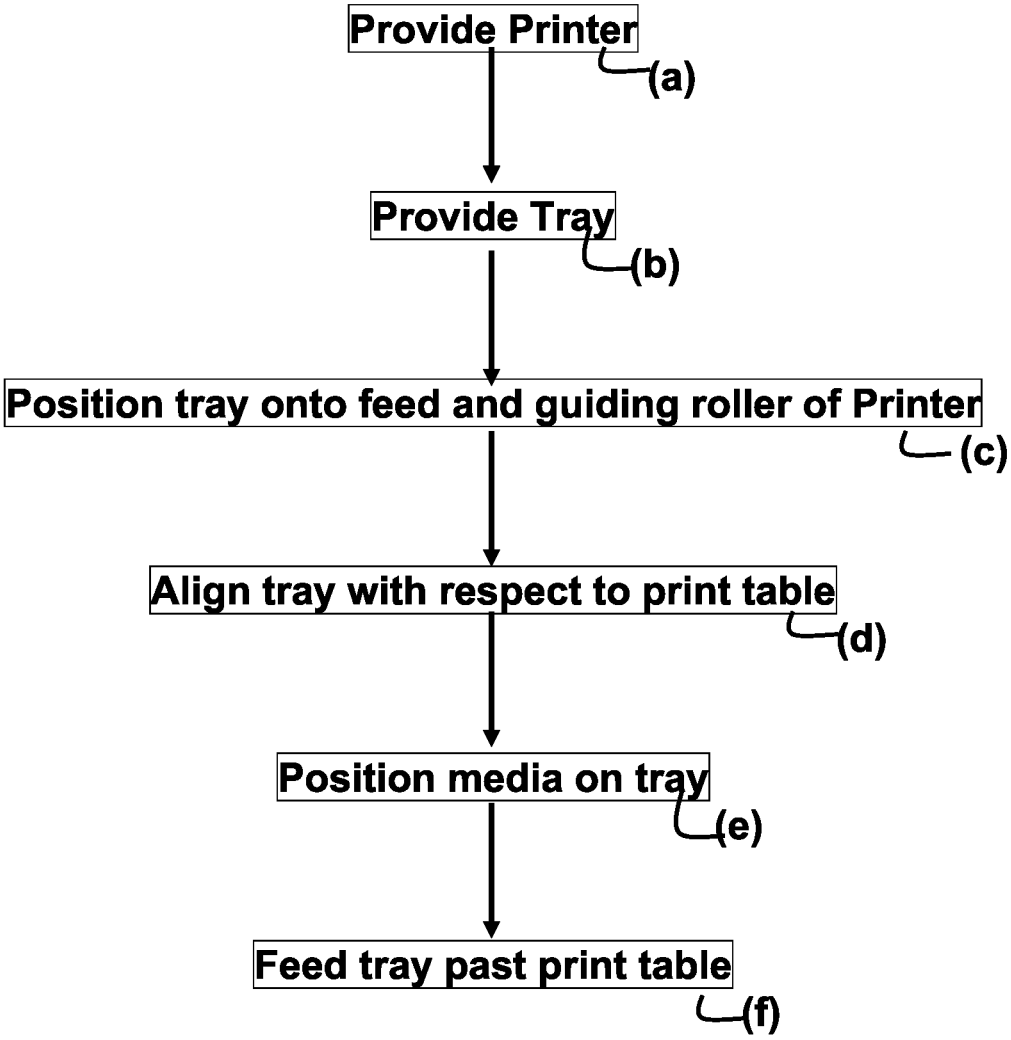

FIG. 7 is a schematic side view of the rollers, print table and print head carriage, vacuum tray and framework, of a triple-mode printer configured for printing onto (typically) flimsy discrete media, and FIG. 8 is a schematic illustration showing how soon-to-be-printed discontinuous media 610" may be loaded into a second framework 620" and after printing the just-printed discontinuous media 610' in a first framework 620', the first framework 610' may be removed and switched with the second, already loaded, framework 620" using the same tray, for large print runs, and FIG. 9 illustrates a method of printing onto discontinuous media.

DESCRIPTION OF THE PREFERRED EMBODIMENTS

In the following description, since the direction of travel of the printer head is generally referred to as from side to side, and printing as described herein is generally referred to as being wide or super-wide printing, the direction perpendicular to the length of the rollers is known as the length, despite it being appreciated in wide and super wide printer especially, the width is the longer direction.

There have been attempts to convert flatbed printers to print onto roll stock, by setting up rollers around a long table designed for flatbed printing onto rigid substrates. This approach does not produce reasonable results when printing onto wide or super-wide media, which may be 3 to 6 meters wide, or more. When printing onto such wide substrates, the rollers have to be substantive so as not to bend, and the roll stock substrate to be printed is stretched unevenly and develops a wavy surface. This adversely affects the resolution of the printing thereupon.

Previous U.S. Pat. No. 7,901,150 to Matan Digital Printing described a digital inkjet printer that can print onto material fed by two separate feed configurations, either a first configuration for continuous sheet media provided as roll stock, wherein the feed roller and guide roller are positioned below the height of the print table, or, onto discontinuous sheets of stiff media wherein the feed roller and guide roller are raised to a second configuration such that the feed roller, print table and guide roller are collinearly aligned.

Guide wheels may be lowered onto the stiff media to apply a pressure onto the upper surface of the stiff media to keep it pressed onto the feed roller.

The patented technology described in U.S. Pat. No. 7,901,150 to Matan Digital Printing adapts a roll to roll wide/super wide printer having a short printing table, to allow printing onto rigid media. A double configuration feed roller system and a wide/super wide digital printer 100 was disclosed that can be used for digital printing onto a continuous substrate supplied on a roll, in a roll to roll printing configuration, or onto a flat sheet in a flat media printing configuration. With reference to FIGS. 1 to 4, an embodiment of Matan's dual mode digital printer 100 is schematically shown. The double configuration described hereinbelow enables the feed roller 116 and guiding roller 120 to be moved between a lower configuration shown in FIG. 1 wherein the upper part of the feed roller 116 and guiding roller 120 are below the level of the print table 110, and a collinear configuration shown in FIG. 2 wherein the feed roller 116 and guiding roller 120 are raised to the height of the print table 110 and are collinear therewith.

As shown in schematic cross section in FIG. 1, when configured for roll to roll printing, the feed roller 116 and guiding roller 120 are below the level of the table 110, and the substrate to be printed 114 is thereby kept taut and ripple free. The spindles 115, 121 of the feed roller 116 and guiding roller 120 are fixedly mounted at each end thereof, onto rockers 122, 124 that are rotatably mounted on axes 126, 128 respectively. Slots 132, 134 are cut through the rockers 122, 124, and pins 136, 138 are fixedly mounted to the support structure 125 to which axes 126, 128 are also fixed.

Figure 1:
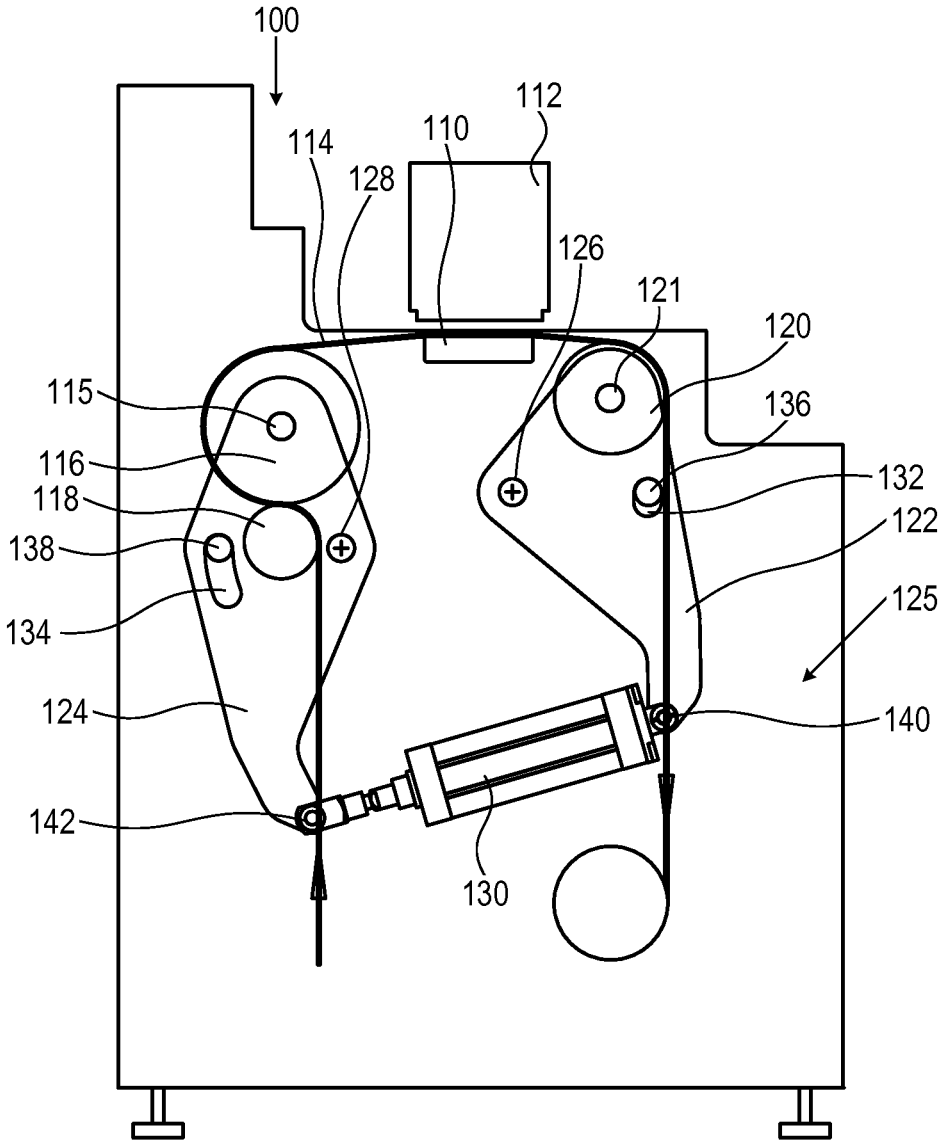
Prior Art Fig. 1

A drive means of variable length, illustrated herein as a piston 130, that may be a hydraulic or pneumatic piston is attached to lower parts 140, 142 of rockers 122, 124, which in FIG. 1 is kept compressed, thereby pulling lower parts 140, 142 towards each other, and forcing the pins 136, 138 to the top edge of slots 132, 134 in which position, the feed roller 116 and guiding roller 120 are below the level of the table 110, and the substrate to be printed 114, is thereby kept taut and ripple free.

It will be appreciated that other drive system, such as springs, worms, motors and the like (not shown) may be substituted instead of piston 130, to give equivalent movement, driving the feed rollers between the two positions.

Figure 2:
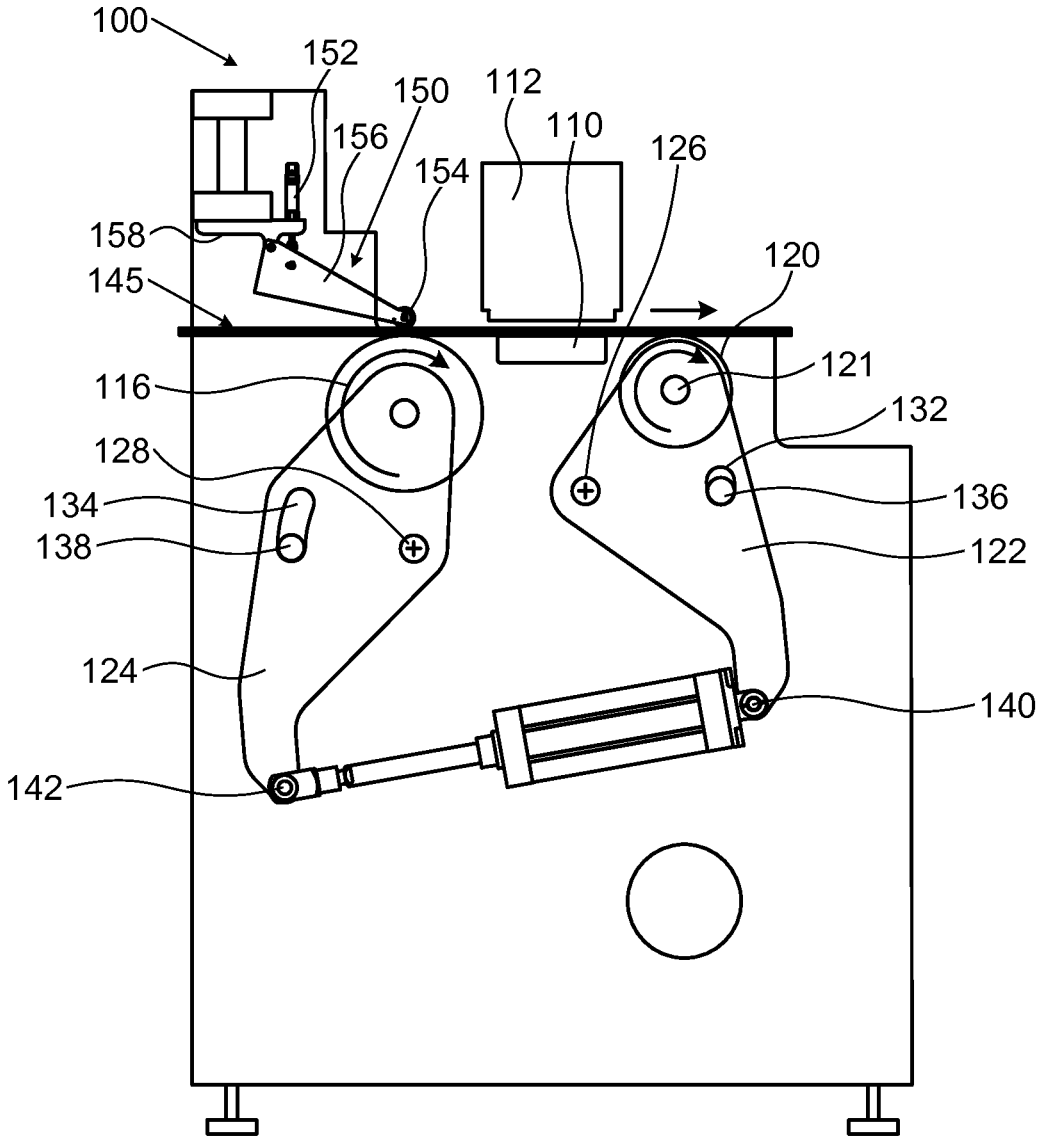
Prior Art Fig. 2

As shown in FIG. 2, to print onto separate sheets of a discontinuous substrate 145, which is typically a less flexible, more rigid, thicker material such as cardboard and the like, the piston is extended. This forces bottom parts 140, 142 of rockers 122, 124 apart, rotating rockers 122, 124 around axes 126, 128, thereby bringing slots 132, 134 upwards around pins 136, 138, so pins 136, 138 contact base of slots 132, 134 and are stopped thereby, preventing further rotation of rockers 122, 124. In this position, the feed roller 116 and guiding roller 120 are at the level of the table 110. A flatbed pressure system 150 is lowered onto the substrate 145 to be printed 115, pressing the substrate 145 onto the feed roller 116. The flatbed pressure system 150 may be a row of individual idling wheels 154 which are attached to arms 156 that pivot down from a common support 158, each arm 156 being pressed downwards by a pressure means 152, which may be a Hookian element such as a helical spring, or a closed piston, for example. The purpose of the flatbed pressure system 150 is only to keep the discontinuous substrate 145 pressed onto the feed roller 116, so that rotation of the feed roller 150 advances the discontinuous substrate 145 over the table 110 so that it may be printed. In this manner, a feed roller 116 is used for incremental advancing of a discontinuous substrate 145 which is typically a relatively rigid or thick discontinuous substrate 145, unsuitable for providing as roll stock.

As illustrated in FIGS. 1 and 2, the drive means may be a rod in cylinder type piston 130 that can be hydraulically or pneumatically powered. The cylinder can be coupled to the rocker 122 of the guiding wheel 120 and the rod may be coupled to the rocker 124 of the feed roller 116. Alternatively and equivalently, the piston 130 may be reversed with the piston rod being coupled to the rocker 122 of the guiding wheel 120 and the cylinder being coupled to the rocker 124 of the feed roller 116. Furthermore, other drive system such as a worm might be substituted without exceeding the scope of the invention. In preferred embodiments, a pair of drive system is used on similar rockers; one at each end of the feed roller 116 and guiding roller 120. This helps ensure accurate, straight feeding of the substrate 114, 145. Strictly speaking however, only one drive system is required.

The feed roller 116 is usually rubber coated to provide a high friction surface. The rollers are rigid by their construction and resist bending. The table 110 often has a square profile and is typically less rigid than the rollers 116, 120. It will be noted that for wide and super wide printing, the width of the table may be several meters. Preferably the table 110 is supported periodically by adjustable supports and the absolute height of the table 110 at each support point may be adjusted to ensure planarity. The rollers 116, 120 may be used for this purpose.

Since the feed roller 116 is moved upwards and forwards when moving from the roll-to-roll lower configuration of FIG. 1 to the flat bed upper configuration of FIG. 2, the feed roller 116 is separated from the pressure roller 118. This separation aids feeding of substrate 114 supplied as roll-stock between pressure roller 118 and the feed roller 116. In the prior art, the pressure roller 118 is typically lowered to achieve this. Since the height of digital printing machines is effectively limited, and there is a need to accommodate further rolls and rollers, etc. such as the supply roll of the substrate 114 to be printed, and the take up roll for the printed substrate 114, space and height is at a premium, and the fact that the feed roller 116 can be lifted and moved forwards, away from the pressure roller 118, provides additional space between feed roller 116 and pressure roller 118 for feeding the substrate 114 therethrough.

Figure 3:
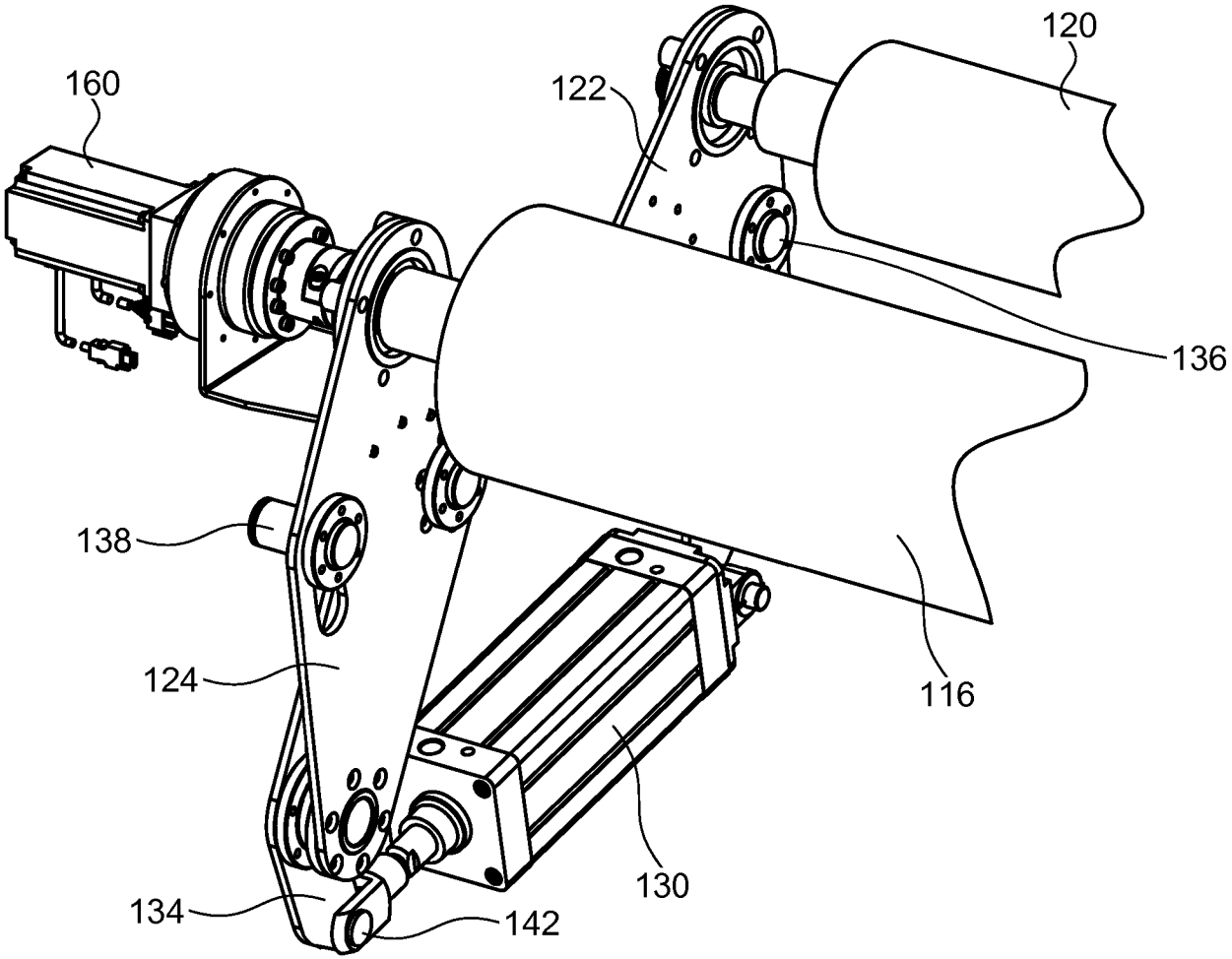
Fig. 3 Prior Art

With reference to FIG. 3, the adjustable roller support system, one end of the feed roller 116 and one end of the guiding roller 120 are shown in isometric projection. It will be noted that the motor unit 160 is coupled directly to the spindle 115 of the feed roller 116 which is incrementally advanced in a stepwise fashion thereby. In the embodiment shown, the motor unit 160 may be attached to the spindle 115 of the feed roller 116 in a fixed alignment therewith, and moves down and up with the feed roller 116 as the feed roller 116 is moved between its lower and upper configurations, shown in FIG. 1 and FIG. 2 respectively.

Figure 4:
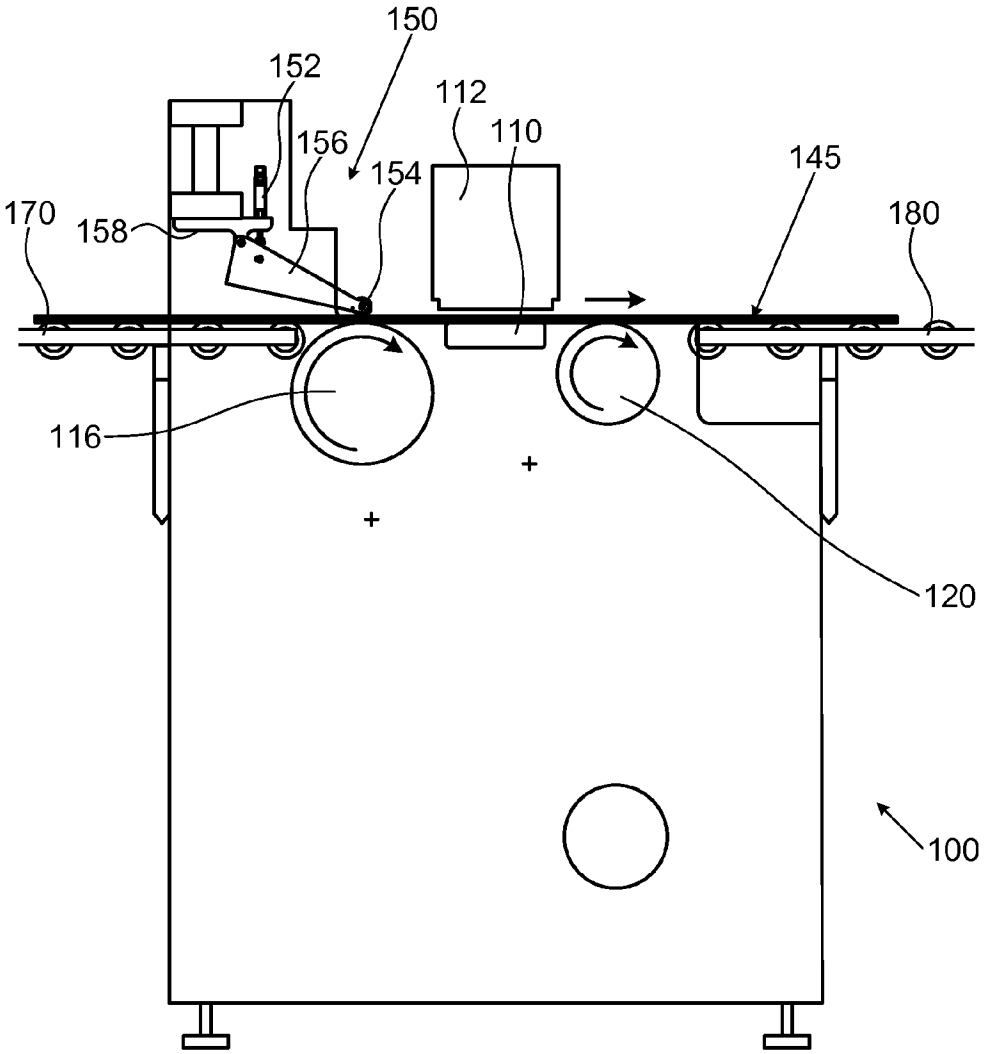
Fig. 4 Prior Art

As shown in FIG. 4, since in Matan's Dual Mode printer the long flat bed table previously required has been eliminated, with the substrate 145 to be printed being advanced past the printing head box 112 that moves from side to side along a single track, by a feed roller 116 it is typically necessary to provide external support to the discontinuous sheet substrate 145 to be printed, even if the substrate 145 is fairly thick and rigid. A convenient way to provide such support is to bring a feeder roller table 170 and a collector roller table 180 into proximal alignment with the rollers of the printing unit 100. A rigid laminar substrate 145 to be printed may be placed on feeder roller table 170 with its front edge resting on feed roller 116, and with the flatbed pressure system 150 applying a pressure thereto, to keep the rigid laminar substrate 145 in contact with the feed roller 116. The feed roller 116 is turned in small steps by the motor unit, and the substrate 145 to be printed is incrementally advanced over the printing table 110 onto guiding roller 120 and then onto the collector roller table 180.

Super wide printers may be 3 meters wide or more. Rigidity becomes important for high resolution printing. Since the digital printer described herein uses a feed roller for advancing discontinuous laminar substrates as well as when printing roll to roll, long printing tables are eliminated and printing table of not more than 20 cm is used. One consequence of this is that the length of the machine 100 is typically well under a meter. Nevertheless accurate forwarding of large substrates 145, 114 to be printed is allowed.

The roller tables 170, 180 shown in FIG. 1 are optional, and the substrate 145 to be printed may alternatively be supported in other ways, such as manually supported by workers, for example. Additionally, where provided, roller tables 170, 180 are utility components that may find a wide range of alternative uses other than for supporting discontinuous substrates 145 when using the digital printer 100 of the inventor for flat bed type printing.

Although Matan's Dual Mode solution, described hereinabove, enables the same printer to print onto roll stock or onto large sheets or media, it's application for large sheets of media is limited to relatively stiff media such as boards of various types, including cardboard and the like. It is not suitable for printing onto flimsy media such as fabrics or paper, unless these are provided as rollstock, since in the flat bed mode, the flimsy media lack the rigidity to remain flat whilst driven past the printheads using the drive rollers.

Furthermore, even when printing onto relatively stiff sheets of media, the media must be provided as large sheets that span the distance between the feed roller 116 and the guide roller 120.

To reduce the need for separate printing machinery, there is a general demand to provide ever greater flexibility with regards to the types of media that may be printed and to the format in which they are provided, and their dimensions.

Wide format printers allow printing wide media. It is useful if the wide format printer can also print narrow media, and individual items. Sometimes it is required to print onto separate sheets of flimsy media such as fabrics and papers, for example. Sometimes it is necessary to print onto discontinuous media such as book covers, beer mats and the like, that are provided as individual, small units prior to printing. Matan's dual mode printer as described in US does not provide a solution for these types of print jobs.

Figure 5A:
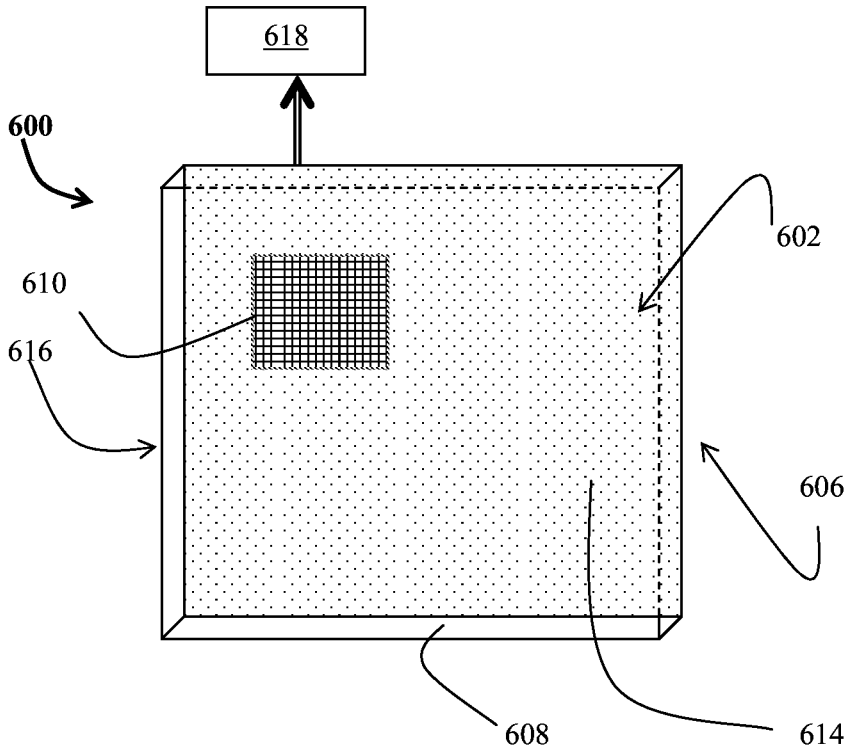
Figure 5B:
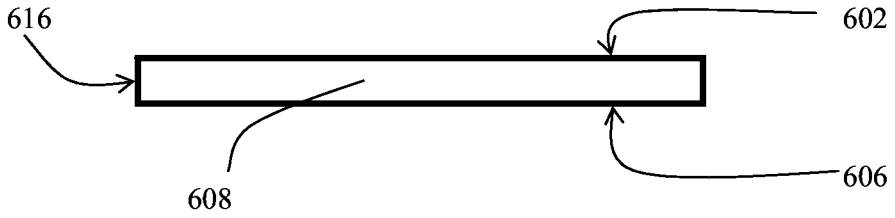

With reference to FIGS. 5A and 5B, a tray 600 is described. The tray 600 may be a flat hollow box consisting of a top plate 602 and a parallel bottom plate 606 joined by a perimeter edge 604 having at least one straight section 608. typically the tray 600 is rectangular. Apart from at their perimeters, the top plate 602 and parallel bottom plate 606 are separated from each other by an air gap, referred to herein as a separation 612. The top plate 602 is provided with an array 614 of holes 616 and the tray 600 may be coupled to a vacuum pump 618, which provides suction through the array of holes 614 and holds flimsy media 610 to the tray 600 thereby.

Tray 600 thus effectively converts the discontinuous and often flimsy media 610 positioned on the tray 600 into a stiff media for printing thereonto, overcoming the intrinsic limitation of dual mode printer 100, and enabling the printing of discontinuous sheets of flimsy media 610, not provided on a roll and also enabling the printing of discrete articles.

The tray 600 may be fabricated from metal. To keep it light and easily movable, tray 600 is typically fabricated from aluminium. A straight edge section 608 of the tray 600 may be used to align the tray with the printer, typically with the feed roller or the edge of the print table, or sometimes with some dedicated edge such as an edge that is piano hinged to the print table, and folded up for alignment thereto and then folded down, out of the way.

The upper surface of upper plate 602 of the tray 600 may be provided with markings that enable the discontinuous media 610 to be aligned with the tray 600 which is itself aligned with the printer 100' (FIG. 7), and in this manner, the discontinuous media 610 is aligned with the printheads 612 of the printer 100' (FIG. 7). The array 614 of holes 616 is typically a rectangular array and the rows and columns of the array of holes 614 may be used to align the media 610 with the tray 600.

Figure 6:
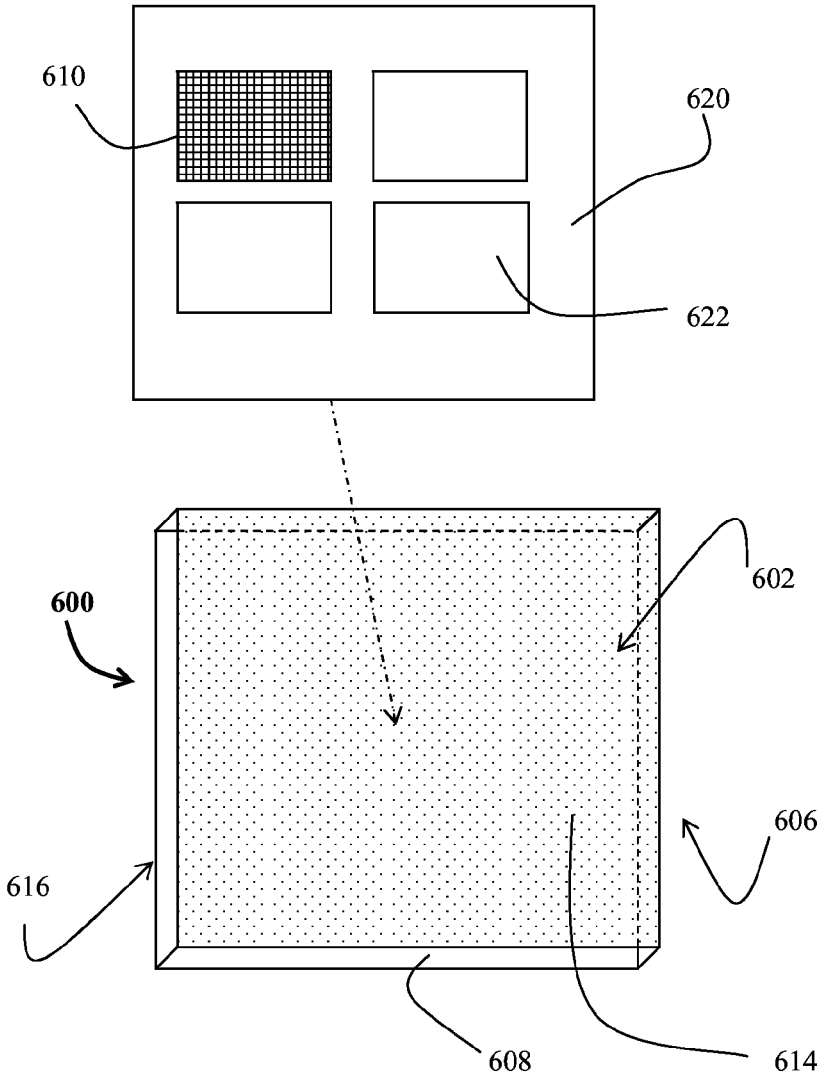

The discontinuous media 610 may be flimsy and flexible. For example, the discontinuous media may be towels, scarves, handkerchiefs and the like, or tee-shirts and sweatshirts, that have previously been printed by silk-screening which in addition to having low resolution, is usually single color. Flimsiness and flexibility is typical of the discontinuous media 610 to be printed by a printer 100' of the present invention, but this is not necessarily the case. The discontinuous media 610 may be individual brochures, booklets, books, and the like that are already printed, cut and folded or bound, but where there is a desire to print additional information or images, such as a dedication, for example, or small rigid articles such as badges or tags for example. With reference to FIG. 6, to facilitate positioning of the discontinuous media 610 onto the tray 600, a framework 620 with cut out apertures 622 may be provided. In one embodiment, the framework 620 is positioned onto the tray 600 which is aligned with the printer using alignment markings thereon or the rows of holes making up the array of holes for vacuum suction or some other surface feature, to align the framework 620 with the tray 600. The tray 600 itself is aligned with the printer and, after each printing, the just-printed discontinuous media 610 is removed from the framework 620 and replaced by soon-to-be-printed discontinuous media 610.

Referring now to FIG. 7, a cross section of a printer 100' is shown. Printer 100' may be substantially like dual mode printer 100, but is able to assume a third configuration wherein the feed roller 116 and the guide roller 120 are able to assume a raised position above the height of the print table 110, essentially making the print table 110 redundant. The tray 600 is shown, spanning the distance between the feed roller 116 and the guide roller 120, supporting a framework 620 with a piece of discrete media 610 in a window 622 of the framework 620; the discrete media 610 being held in place by the framework 620 or by vacuum suction. The feed roller 116 feeds the tray 600 past the print heads 612, enabling printing onto the media 610. Feed roller 116 and guide roller 120 are supported by spindles 115, 116 that may be coupled to the rockers 124, 122 (FIG. 1), which are adapted to be positionable in a third position to provide this raised configuration.

With reference to FIG. 8, alternatively, soon-to-be-printed discontinuous media 610" may be loaded into a second framework 620" and after printing the just-printed discontinuous media 610' in a first framework 620', the first framework 610' is removed and switched with the second, already loaded, framework 620". In a variant of this, a longer tray that is double the length of the media may be used, such that as one end is being printed, the other end may be loaded and unloaded.

Thus with reference to FIG. 9 a method of printing onto discontinuous media consists of:

(a) providing a digital printer 100;

(b) positioning a tray 600 onto a feed roller 116 and guiding roller 120;

(c) aligning the tray 600 with respect to the feed roller 116;

(d) positioning the discontinuous media 610 onto the tray 600, and (e) feeding the tray 600 past the printhead 612 using the feed roller 116.

Typically, the tray 600 is a vacuum tray such as that described hereinabove and shown in FIG. 6, and the method step (d) comprises holding the discontinuous media to the plate using suction from the vacuum pump 618 via the array 614 of holes 616.

The method may be used with a printer 100 as described hereinabove with reference to FIGS. 1 to 4, but modified to assume a third, raised configuration, thereby rendering the print table 110 redundant.

The discontinuous media 610 may be flimsy or may be rigid.

Optionally step (d) further comprises providing a framework and positioning the framework to at least partially cover the upper plate, the framework defining apertures into which the discontinuous media to be printed may be positioned.

Step (c) of aligning the tray may comprise aligning a straight edge of the tray with the printhead track. This may be achieved by aligning an edge of the tray with an edge of the print table; with the feed roller or with an alignment edge that is itself in fixed alignment with the print table is used to align the plate.

The wide format printer 100' typically includes sophisticated alignment means for detecting the edges of the media to be printed which can be used to detect the edges of the tray or of the individual pieces of flexible media. The tray 600 may be and indeed is typically smaller than the width of the printer 100' and the tray 600 may be positioned along the printer using an edge positioner that is coupleable to the track along which the printer head reciprocates, or to the printhead carriage.

Optionally, two or more trays 600 may be arranged adjacent to each other across a wide format or extra wide format printer 100' to enable utilizing more of the width of the wide format printer 100'.

Although described herein with reference to Matan's dual mode wide format printer 100 with appropriate adaptation thereof, it will be appreciated that aspects of the invention may be used with other printer types.

Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A system for printing onto discontinuous media comprising a printer, a vacuum pump and a tray; the printer comprising a print head and a feed roller for roll to roll printing by forwarding media passed the print head; the tray comprising an upper plate joined to a parallel lower plate by a perimeter edge, the upper plate and lower plate being separated by a separation to form a hollow box, the upper plate being provided with an array of through holes, hollow box being coupleable to a vacuum pump for evacuation of air from within, such that the discontinuous media placed over at least a portion of the array of holes is held in place by suction created by the vacuum pump and is advanced past the print head by the feed roller for printing thereonto, wherein the system further comprises a framework for partially covering the upper plate of the tray and providing windows into which media to be printed may be positioned.

2. The system of claim 1, wherein the printer comprises a print table, the feed roller and a guiding roller, and is selectively configurable between:

a lowered configuration wherein the feed roller and guiding roller are positioned below the print table for roll to roll printing of flexible media;

a coplanar position wherein said feed roller, print table and guide roller are in linear alignment for flat bed printing onto discrete sheets of substantially stiff media, and a raised configuration, wherein the feed roller and guide roller are positioned above the print table and the tray is supported by the feed roller and the guide roller and is separated from the print table by a gap.

3. The system of claim 2, wherein each of said pair of rollers on a spindle fixed to a rocker plate on each end, each rocker plate being movable about an axle fixed to the fixed support, the moving of each rocker between the lowered position, the coplanar position and the raised position being driven by a drive system, and determined by peg in slot mechanisms, wherein each rocker comprises a slot therethrough through which a peg fixed to the fixed support passes, and each rocker can be moved between three positions to selectively position the feed roller and guiding roller below, in line with the printing table.

4. The system of claim 1 wherein the tray is at least 40 inches wide.

5. The system of claim 1 wherein the tray is at least 60 inches wide.

6. The system of claim 1, wherein the printer is a wide format or extra wide format printer.

7. A system for printing onto discontinuous media comprising a wide format printer, a vacuum pump and a plurality of trays; the printer comprising a print head and a feed roller for roll to roll printing by forwarding media passed the print head; the plurality of trays each comprising an upper plate joined to a parallel lower plate by a perimeter edge, the upper plate and lower plate being separated by a separation to form a hollow box, the upper plate being provided with an array of through holes, hollow box being coupleable to a vacuum pump for evacuation of air from within, such that the discontinuous media placed over at least a portion of the array of holes is held in place by suction created by the vacuum pump and is advanced past the print head by the feed roller for printing thereonto, such that the plurality of trays are positioned across the printer and are moved past the print head by the feed roller.

8. The system of claim 7 further comprising a framework for partially covering the upper plate of each tray and providing windows into which media to be printed may be positioned.

9. A method of printing onto discontinuous media, by (i) providing a digital printer comprising a print head;

a feed roller;

a guide roller;

a vacuum pump and a tray comprising an upper plate joined to a parallel lower plate by a perimeter edge, the upper plate and lower plate being separated by a separation to form a hollow box, the upper plate being provided with an array of through holes, hollow box being coupleable to a vacuum pump for evacuation of air from within;

and further comprises providing a framework and positioning the framework to partially cover the upper plate, the framework defining windows into which the discontinuous media to be printed may be positioned;

(ii) positioning the discontinuous media on the tray and holding in place using the vacuum pump;

(iii) positioning the tray onto the feed roller and the guiding roller, and (iv) forwarding the tray past the print head using the feed roller wherein step (i).

10. The method of claim 9 wherein the digital printer further comprises a print table and is configurable to selectively print either:

a) onto continuous media in a roll to roll configuration wherein the feed roller and the guide roller are below the print table;

b) onto large sheets of stiff discontinuous media in a flat bed configuration wherein the feed roller and the guide roller are in line with the print table, or c) onto discontinuous media not provided as large stiff sheets, wherein the feed roller and the guide roller are above the print table.

11. The method of claim 10, wherein the discontinuous media not provided as large stiff sheets is flimsy.

12. The method of claim 9, wherein the discontinuous media not provided as large stiff sheets is provided as small discrete objects.

13. The method of claim 9 wherein step (iii) further comprises aligning the tray with the feed roller.

14. The method of claim 13 wherein aligning the tray with the feed roller comprises aligning an edge of the tray with one of the group consisting of: an edge of the print table; the feed roller; a track along which the printer head reciprocates, and an alignment edge that is itself in fixed alignment with the print table is used to align the plate.

15. The method of claim 13 wherein aligning the tray with the feed roller comprises aligning an edge of the tray with an edge positioner that is coupleable to a track along which the printer head reciprocates.

16. The method of claim 15 wherein the edge positioner is coupleable to the printer head carriage.

17. The method of claim 9 wherein the printer is a wide format printer or a super-wide format printer.

18. A method of printing onto discontinuous media, by (i) providing a wide format digital printer comprising a print head;

a feed roller;

a guide roller;

a vacuum pump and a plurality of trays each comprising an upper plate joined to a parallel lower plate by a perimeter edge, the upper plate and lower plate being separated by a separation to form a hollow box, the upper plate being provided with an array of through holes, hollow box being coupleable to a vacuum pump for evacuation of air from within;

(ii) positioning the discontinuous media on the trays and holding in place using the vacuum pump;

(iii) positioning the plurality of trays along the print table onto the feed roller and the guiding roller, and (iv) forwarding the trays past the print head using the feed roller.

19. The method of claim 18 wherein step (i) further comprises providing a framework and positioning the framework to partially cover the upper plate, the framework defining windows into which the discontinuous media to be printed may be positioned.

20. A tray and framework for retrofitting to a wide format printer for supporting small pieces of discontinuous media and allowing the wide format printer to print the small pieces of discontinuous media, such that the tray may be positioned on the feed roller and guide roller of a roll to roll printer and moved by the feed roller past a printhead; the tray comprising an upper plate joined to a parallel lower plate by a perimeter edge, the upper plate and lower plate being separated by a separation to form a hollow box, the upper plate comprising an array of through holes, the tray being coupleable to a vacuum pump for evacuation of air from within, such that the discontinuous media placed over at least a portion of the array of holes is held in place by suction created by the vacuum pump, and the framework for partially covering the upper plate of the tray and for providing apertures into which the discontinuous media to be printed may be positioned.

* * * * *